US010134228B2

(12) United States Patent
McIntyre et al.

(10) Patent No.: US 10,134,228 B2
(45) Date of Patent: Nov. 20, 2018

(54) CUSTOMIZATION OF GAME PLAY THROUGH PERSONAL GAMING DEVICE

(71) Applicant: IGT, Las Vegas, NV (US)

(72) Inventors: Derek P. McIntyre, Reno, NV (US); Michael B. Gardner, Reno, NV (US); Xuedong Chen, Reno, NV (US)

(73) Assignee: IGT, Las Vegas, NV (US)

( * ) Notice: Subject to any disclaimer, the term of this patent is extended or adjusted under 35 U.S.C. 154(b) by 9 days.

(21) Appl. No.: 15/197,218

(22) Filed: Jun. 29, 2016

(65) Prior Publication Data

US 2016/0307399 A1 Oct. 20, 2016

Related U.S. Application Data

(63) Continuation of application No. 14/032,869, filed on Sep. 20, 2013, now Pat. No. 9,390,582.

(51) Int. Cl.
*G07F 17/32* (2006.01)
*G07F 17/34* (2006.01)

(52) U.S. Cl.
CPC ..... *G07F 17/3227* (2013.01); *G07F 17/3211* (2013.01); *G07F 17/3218* (2013.01); *G07F 17/3225* (2013.01); *G07F 17/34* (2013.01)

(58) Field of Classification Search
CPC ..... G07F 17/3227; G07F 17/3211; G07F 17/3218; G07F 17/3225; G07F 17/34
See application file for complete search history.

(56) References Cited

U.S. PATENT DOCUMENTS

| | | | |
|---|---|---|---|
| 4,760,245 | A | 7/1988 | Fukaya |
| 4,856,787 | A | 8/1989 | Itkis |
| 5,178,390 | A | 1/1993 | Okada |
| 5,634,849 | A | 6/1997 | Abecassis |
| 5,772,509 | A | 6/1998 | Weiss |
| 6,003,013 | A | 12/1999 | Boushy et al. |
| 6,012,983 | A | 1/2000 | Walker et al. |
| 6,068,552 | A | 5/2000 | Walker et al. |
| 6,077,163 | A | 6/2000 | Walker et al. |
| 6,135,884 | A | 10/2000 | Luciano et al. |
| 6,244,958 | B1 | 6/2001 | Acres |

(Continued)

FOREIGN PATENT DOCUMENTS

WO WO 03027970 4/2003

*Primary Examiner* — David L Lewis
*Assistant Examiner* — Matthew D. Hoel
(74) *Attorney, Agent, or Firm* — Neal, Gerber & Eisenberg LLP

(57) ABSTRACT

Gaming systems and methods for customizing game play on a gaming machine with custom media are described herein. The gaming machine includes a cabinet, a display, a user input mechanism, an interface configured to wirelessly communicate with a portable electronic device controlled by a player, and a game controller. The game controller is configured to provide a default game play session of a wager-based game, facilitate a data connection between the gaming machine and the portable electronic device through the interface, and receive custom game media and customization settings. The game controller is further configured to store the custom game media and customization settings and to provide a customized game play session of the wager-based game according to the customization settings and the custom game media.

21 Claims, 9 Drawing Sheets

(56) References Cited

U.S. PATENT DOCUMENTS 6,306,038 B1 10/2001 Graves et al.
6,350,199 B1 2/2002 Williams et al.
6,371,852 B1 4/2002 Acres
6,374,287 B1 4/2002 Goldstein
6,379,246 B1 4/2002 Dabrowski
6,511,377 B1 1/2003 Weiss
6,520,856 B1 2/2003 Walker et al.
6,554,707 B1 4/2003 Sinclair et al.
6,606,602 B1 8/2003 Kolls
6,645,077 B2 * 11/2003 Rowe ..... A63F 13/12 463/25
6,709,331 B2 3/2004 Berman
6,880,079 B2 4/2005 Kefford et al.
6,997,807 B2 2/2006 Weiss
7,022,017 B1 4/2006 Halbritter et al.
7,033,276 B2 4/2006 Walker et al.
7,040,987 B2 5/2006 Walker et al.
7,140,964 B2 11/2006 Walker et al.
7,198,571 B2 * 4/2007 LeMay ..... G07F 17/32 463/25
7,322,884 B2 1/2008 Emori et al.
7,918,738 B2 * 4/2011 Paulsen ..... G06Q 30/0209 273/139
7,941,756 B1 * 5/2011 Moore ..... G06F 9/4443 715/762
7,972,213 B2 7/2011 Walker et al.
8,087,996 B2 1/2012 Walker et al.
8,226,474 B2 7/2012 Nguyen et al.
8,360,865 B2 1/2013 Walker et al.
8,435,105 B2 5/2013 Paulsen
8,485,906 B2 7/2013 Walker et al.
8,491,392 B2 * 7/2013 Baerlocher ..... G07F 17/34 463/25
8,500,546 B2 8/2013 Walker et al.
8,512,139 B2 8/2013 Williams et al.
8,545,308 B2 10/2013 Walker et al.
8,545,321 B2 10/2013 Baerlocher et al.
8,597,111 B2 12/2013 LeMay et al.
8,608,552 B2 12/2013 Walker et al.
8,608,569 B2 12/2013 Carrico et al.
8,622,842 B2 1/2014 Nguyen et al.
8,721,434 B2 5/2014 Nelson et al.
8,827,813 B2 9/2014 LeMay et al.
8,827,814 B2 9/2014 LeMay et al.
8,845,418 B2 9/2014 Walker et al.
8,876,595 B2 11/2014 Nelson et al.
9,017,173 B2 * 4/2015 Baerlocher ..... G07F 17/34 463/30
9,542,038 B2 * 1/2017 van Os ..... G06F 9/4443
2001/0044337 A1 11/2001 Rowe et al.
2002/0002075 A1 1/2002 Rowe
2002/0077170 A1 6/2002 Johnson et al.
2002/0111210 A1 8/2002 Luciano, Jr. et al.
2002/0142825 A1 10/2002 Lark et al.
2002/0142846 A1 10/2002 Paulsen
2002/0161645 A1 10/2002 Walker et al.
2003/0003988 A1 1/2003 Walker et al.
2003/0032479 A1 2/2003 LeMay et al.
2003/0083943 A1 5/2003 Adams et al.
2003/0216961 A1 11/2003 Barry
2004/0103444 A1 5/2004 Weinberg et al.
2004/0127284 A1 7/2004 Walker et al.
2004/0142747 A1 * 7/2004 Pryzby ..... G07F 17/32 463/35
2004/0209690 A1 10/2004 Bruzzese et al.
2005/0020358 A1 1/2005 Cram
2005/0170890 A1 * 8/2005 Rowe ..... G07F 17/32 463/42
2005/0277469 A1 * 12/2005 Pryzby ..... G07F 17/32 463/35
2005/0282638 A1 12/2005 Rowe
2006/0035707 A1 2/2006 Nguyen et al.
2006/0041586 A1 2/2006 Nassef
2006/0068898 A1 3/2006 Maya
2006/0094508 A1 5/2006 D'Amico et al.
2006/0189382 A1 8/2006 Muir et al.
2006/0190482 A1 8/2006 Kishan et al.
2006/0217202 A1 9/2006 Burke et al.
2006/0264256 A1 11/2006 Gagner et al.
2007/0004510 A1 1/2007 Underdahl et al.
2007/0015569 A1 1/2007 Norton et al.
2007/0021198 A1 1/2007 Muir et al.
2007/0032288 A1 2/2007 Nelson et al.
2007/0180400 A1 8/2007 Zotov et al.
2007/0243925 A1 10/2007 LeMay et al.
2007/0243928 A1 10/2007 Iddings
2007/0243934 A1 10/2007 Little et al.
2008/0009344 A1 1/2008 Graham et al.
2008/0058065 A1 3/2008 Okada
2008/0096650 A1 * 4/2008 Baerlocher ..... G07F 17/3255 463/30
2008/0274798 A1 11/2008 Walker et al.
2008/0300049 A1 12/2008 Anderson et al.
2008/0318655 A1 12/2008 Davies
2009/0098943 A1 4/2009 Weber et al.
2009/0104954 A1 4/2009 Weber et al.
2009/0233705 A1 9/2009 LeMay et al.
2010/0105454 A1 4/2010 Weber et al.
2010/0113161 A1 5/2010 Walker et al.
2010/0227683 A1 9/2010 Walker et al.
2010/0285859 A1 11/2010 Costa
2011/0252344 A1 * 10/2011 van Os ..... G06F 9/4443 715/763
2013/0017884 A1 1/2013 Price et al.
2013/0035157 A1 2/2013 Weber et al.
2013/0053136 A1 2/2013 LeMay et al.
2013/0053144 A1 2/2013 Nicely
2013/0053148 A1 2/2013 Nelson et al.
2013/0084963 A1 4/2013 Shorrock et al.
2013/0116041 A1 5/2013 Walker et al.
2013/0165210 A1 6/2013 Nelson et al.
2013/0237314 A1 9/2013 Cannon et al.
2013/0296028 A1 * 11/2013 Baerlocher ..... G07F 17/34 463/25
2013/0310158 A1 11/2013 Walker et al.
2013/0324230 A1 * 12/2013 Iddings ..... G07F 17/32 463/25
2013/0337878 A1 12/2013 Shepherd et al.
2013/0344942 A1 12/2013 Price et al.
2014/0011571 A1 1/2014 Roper et al.
2014/0011580 A1 1/2014 Walker et al.
2014/0018153 A1 1/2014 Nelson et al.
2014/0018155 A1 1/2014 Nelson et al.
2014/0018176 A1 1/2014 Walker et al.
2014/0045584 A1 2/2014 Walker et al.
2014/0087853 A1 3/2014 LeMay et al.
2014/0087865 A1 3/2014 Carrico et al.
2014/0155162 A1 6/2014 Mattice et al.
2014/0278926 A1 9/2014 Close et al.
2014/0295930 A1 10/2014 Walker et al.

* cited by examiner

| BET AMOUNT | 1 | 2 | 3 | 4 |
|---|---|---|---|---|
| ROYAL FLUSH | 250 | 500 | 750 | 1000 |
| STRAIGHT FLUSH | 50 | 100 | 150 | 200 |
| 4 OF A KIND | 25 | 50 | 75 | 100 |
| FULL HOUSE | 9 | 18 | 27 | 36 |
| FLUSH | 6 | 12 | 18 | 24 |
| STRAIGHT | 4 | 8 | 12 | 16 |
| 3 OF A KIND | 3 | 6 | 9 | 12 |
| TWO PAIR | 2 | 4 | 6 | 8 |
| PAIR | 1 | 2 | 3 | 4 |

CUSTOMIZATION OF GAME PLAY THROUGH PERSONAL GAMING DEVICE

PRIORITY CLAIM

This application is a continuation of, claims the benefit of and priority to U.S. patent application Ser. No. 14/032,869, filed on Sep. 20, 2013, the entire contents of which is incorporated by reference herein.

BACKGROUND

Casino patrons often carry portable electronic devices while visiting the casino. For example, many patrons carry smartphones (e.g., iPhones, Android devices, Blackberry devices, Windows devices), tablets (e.g., iPads, Android Nexus tablets, etc.), PDAs, portable media players (e.g., iPods, Zunes, etc.), laptops, and other portable electronic devices. Often, these devices can provide access to networks, including access to the Internet, through wireless connections. Casino patrons use the portable electronic devices to contact other people, check e-mails, surf the Internet, play games, browse social media sites, and so on.

In order to allow a personal portable electronic device to interface with the gaming systems and gaming networks of a casino, the casino may require that the patron to download an application onto the portable electronic device prior to allowing the device to access the casino's gaming system. The application may be configured to allow the portable electronic device to interface with the gaming network and allow the gaming system to communicate information to the player via the portable electronic device.

SUMMARY

An exemplary embodiment relates to a gaming machine. The gaming machine includes a cabinet. The gaming machine further includes a display coupled to the cabinet. The gaming machine includes a user input mechanism coupled to the cabinet. The gaming machine further includes an interface coupled to the cabinet, wherein the interface is configured to wirelessly communicate with a portable electronic device controlled by a player of the gaming machine. The gaming machine includes a game controller coupled to the cabinet. The game controller is configured to provide a default game play session of a wager-based game, wherein the default game play session includes default game media to the player through the display. The game controller is further configured to facilitate a data connection between the gaming machine and the portable electronic device through the interface. The game controller is configured to receive custom game media and customization settings. The game controller is further configured to store the custom game media and customization settings in a memory. The game controller is configured to provide a customized game play session of the wager-based game according to the customization settings, wherein the customized game play session presents the wager-based game using the custom game media in place of at least a portion of the default game media.

Another exemplary embodiment relates to a method in a gaming system including a gaming machine. The method includes providing default game play of a wager-based game on the gaming machine, wherein the default game play includes presenting default game media to a player through a display of the gaming machine. The method further includes facilitating a data connection between the gaming system and a portable electronic device. The method includes receiving custom game media and customization settings. The method further includes storing the custom game media and customization settings in a memory of the gaming system. The method includes providing customized game play of the wager-based game on the gaming machine, wherein the customized game play includes presenting the custom game media in place of at least a portion of the default game media.

Yet another exemplary embodiment relates to a non-transitory computer readable media with computer-executable instructions embodied thereon. The instructions, when executed by a processor, cause the processor to provide default game play of a wager-based game on a gaming machine, wherein the default game play includes presenting default game media to a player through a display of the gaming machine. The instructions, when executed by the processor, further cause the processor to facilitate a data connection between a gaming system and a portable electronic device. The instructions, when executed by the processor, cause the processor to receive custom game media and customization settings from the player. The instructions, when executed by the processor, further cause the processor to store the custom game media and customization settings in a memory of the gaming system. The instructions, when executed by the processor, cause the processor to provide customized game play of the wager-based game on the gaming machine, wherein the customized game play includes presenting the custom game media in place of at least a portion of the default game media.

BRIEF DESCRIPTION OF THE FIGURES

The details of one or more implementations are set forth in the accompanying drawings and the description below. Other features, aspects, and advantages of the disclosure will become apparent from the descriptions, the drawings, and the claims, in which:

DETAILED DESCRIPTION

Numerous specific details may be set forth below to provide a thorough understanding of concepts underlying the described implementations. It may be apparent, however, to one skilled in the art that the described implementations may be practiced without some or all of these specific details. In other instances, some process steps have not been described in detail in order to avoid unnecessarily obscuring the underlying concept.

Gaming systems and methods that encourage a player's use of the player's personal portable electronic devices are described. The gaming systems can include a number of features that encourage and enable the use of the portable electronic devices. In particular embodiments, electronic gaming machines and/or gaming servers used in the gaming system include interfaces for sending and receiving communications with portable electronic devices. A portable electronic device communicating with the gaming system can be used to provide media to gaming machines in order to customize game play on the gaming machines for an individual patron (e.g., photos, music, sounds, etc.). Still further, the gaming system may require the patron to install a casino application on the portable electronic device to be used with the gaming system.

Figure 1:
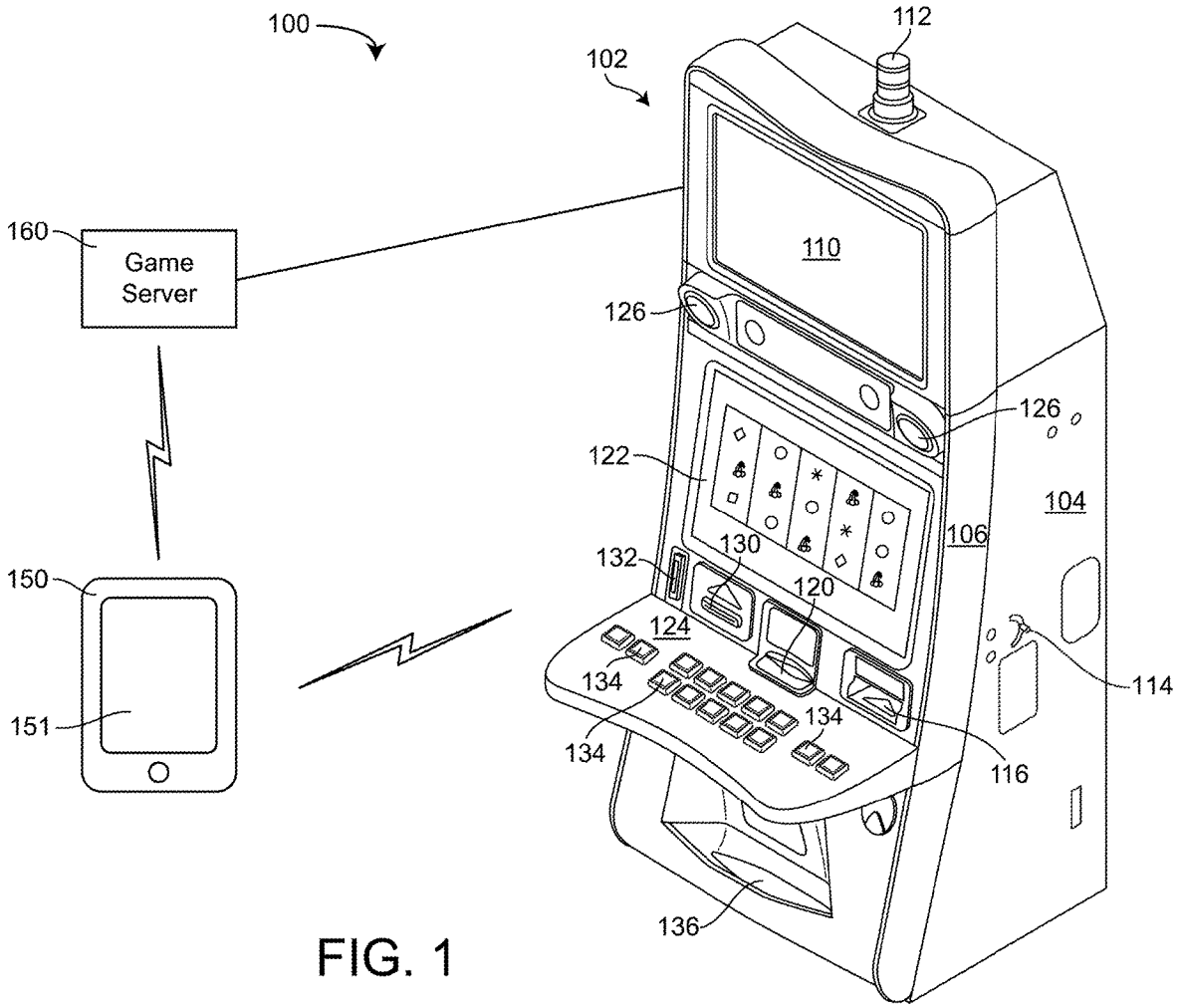
FIG. 1 is a perspective view of a gaming system according to an exemplary embodiment.

Referring to FIG. 1, gaming system 100 is shown according to an exemplary embodiment. Gaming system 100 includes gaming machine 102 and portable electronic device 150. Gaming system 100 optionally includes game server 160. Gaming machine 102 includes main cabinet 104. Main cabinet 104 provides a secure enclosure that prevents tampering with device components, such as a game controller (not shown) located within the interior of main cabinet 104. Main cabinet 104 includes an access mechanism, such as door 106, which allows the interior of gaming machine 102 to be accessed. Actuation of door 106 may be controlled by locking mechanism 114. In some embodiments, locking mechanism 114, door 106, and the interior of main cabinet 104 may be monitored with security sensors of various types to detect whether the interior has been accessed. For instance, a light sensor may be provided within main cabinet 104 to detect a change in light-levels when door 106 is opened and/or an accelerometer may be attached to door 106 to detect when door 106 is opened.

Gaming machine 102 includes any number of user interface devices that convey sensory information to a user and/or receive input from the user. For example, gaming machine 102 may include a first electronic display 110, a second electronic display 122, speakers 126, and/or a candle device 112 to convey information to the user of gaming machine 102. Gaming machine 102 includes console 124 having one or more inputs 134 (e.g., buttons, track pads, etc.) configured to receive input from a user. A controller (not shown) within gaming machine 102 may run a game, such as a wager-based game, in response to receiving input from a user via inputs 134 or displays 110, 122. For example, inputs 134 may be operated to place a wager in the game and to run the game. In response, the controller may cause reels shown on display 122 to spin, such as with a slot game, and/or display 110 to display the results of the game.

Gaming machine 102 may also include devices for conducting a wager-based game. For example, gaming machine 102 may include ticket acceptor 116 and printer 120. In various embodiments, gaming machine 102 may be configured to run on credits that may be redeemed for money and/or other forms of prizes. Ticket acceptor 116 may read an inserted ticket having one or more credits usable to play a game on gaming machine 102. For example, a player of gaming machine 102 may wager one or more credits within a video slot game. If the player loses, the wagered amount may be deducted from the player's remaining balance on gaming machine 102. However, if the player wins, the player's balance may be increased by the amount won. Any remaining credit balance on gaming machine 102 may be converted into a ticket via printer 120. For example, a player of gaming machine 102 may cash out of the machine by selecting to print a ticket via printer 120. The ticket may then be used to play other gaming machines or redeemed for cash and/or prizes. According to various embodiments, gaming machine 102 may record data regarding its receipt and/or disbursement of credits. For example, gaming machine 102 may generate accounting data whenever a result of a wager-based game is determined. In some embodiments, gaming machine 102 may provide accounting data to a remote data collection device, allowing the remote monitoring of gaming machine 102.

In one embodiment, gaming machine 102 includes loyalty card acceptor 130. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing gaming machine 102. For example, a user having a loyalty account may be given a bonus turn on gaming machine 102 or credited loyalty points for playing gaming machine 102. Such loyalty points may be exchanged for loyalty rewards (e.g., a free meal, a free hotel stay, a free room upgrade, discounts, etc.).

Still referring to FIG. 1, in some embodiments, gaming system 100 includes game server 160. Game server 160 communicates with gaming machine 102 through a gaming network. Game server 160 may be used to store gaming data generated at gaming machine 102. Game server 160 may store player account information (e.g., player loyalty account information, player financial information, etc.). Game server 160 may further be used to provide networked game play in which game server 160 executes at least a portion of the game program for display on gaming machine 102. Still further, game server 160 may facilitate multiplayer gaming between multiple gaming machines within the casino.

Gaming system 100 is configured to communicate with portable electronic device 150. Portable electronic device 150 may be a smart phone, a tablet computer, a PDA, a portable media player, a digital camera, a laptop computer, or the like. Portable electronic device 150 can communicate directly with gaming machine 102 through a wireless network interface (e.g., 802.11, Bluetooth, Zigbee, infrared, etc.) or a wired interface (e.g., gaming machine 102 may include a wired connector such as an Ethernet or USB connector). Alternatively, or additionally, portable electronic device 150 communicates with server 160 through a wireless network interface (e.g., 802.11, Bluetooth, Zigbee, infrared, etc.). In order to interface with gaming machine 102 and/or game server 160, gaming system 100 may require that portable electronic device 150 be executing a gaming system application (e.g., a smartphone application for the casino where gaming system 100 is installed).

The gaming system application may be offered through an online application store or download host accessible through the Internet. Alternatively, the gaming system application may be offered for download through a local area network in the casino. The gaming system application enables portable electronic device 150 to communicate with gaming system 100 equipment, including gaming machine 102 and/or game server 160. The gaming system application may provide a portal to the player to manage casino related accounts (e.g., the player's loyalty account, the player's credit accounts, etc.), view casino information (e.g., casino special events and advertising), enable portable electronic device 150 to function as a player loyalty card, and/or allow portable electronic device 150 to function as a cashless gaming instrument. As described in further detail below, the gaming system application allows a player of gaming machine 102 to use portable electronic device 150 to supplement or enhance game play on gaming machine 102. For example, prior to beginning game play on gaming machine 102, a player may upload media stored on portable electronic device 150 (e.g., photos, music, sounds, etc.) to gaming machine 102 and instruct gaming machine 102 to integrate the uploaded media into the game such that the media is output to the player during game play.

Figure 2:
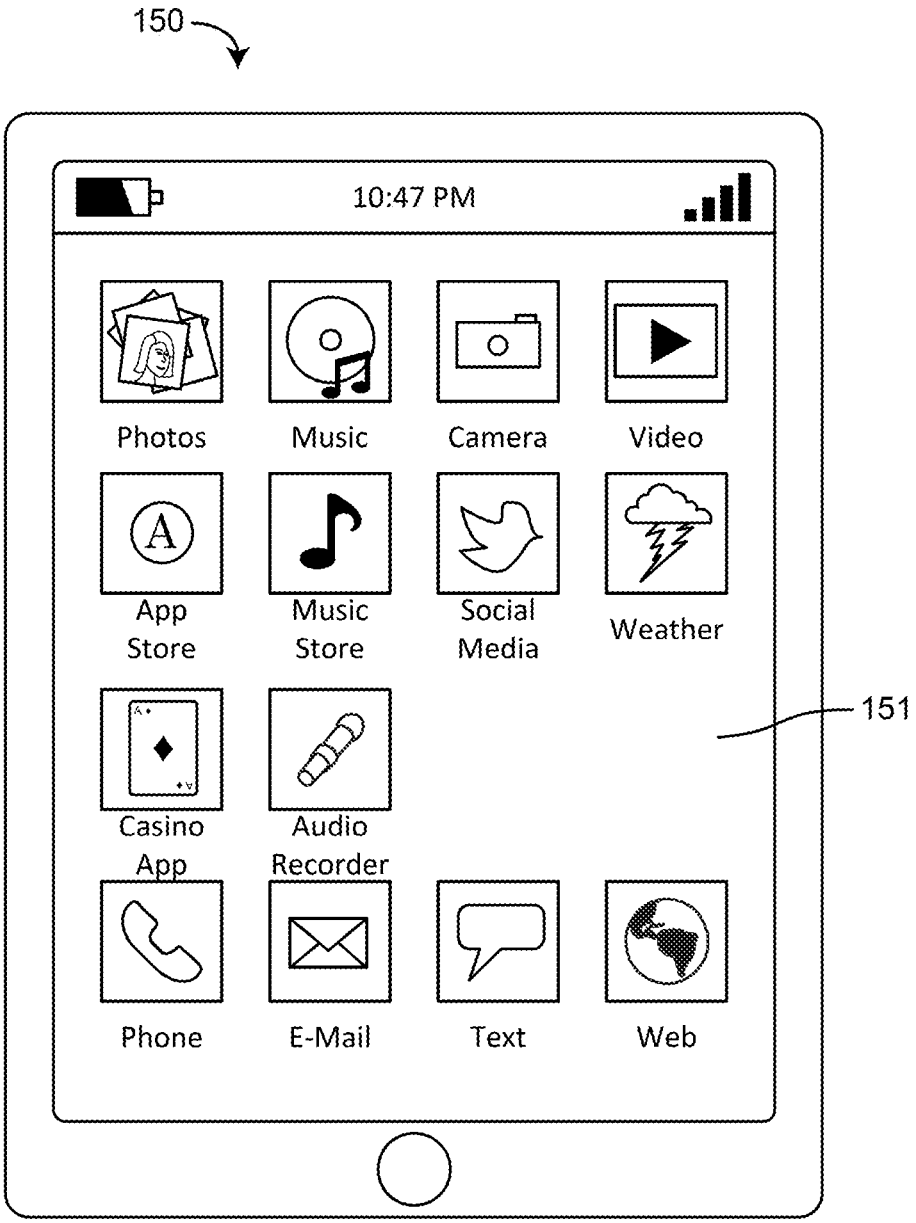
FIG. 2 is a view of a portable electronic device according to an exemplary embodiment.

Referring to FIG. 2, portable electronic device 150 is shown according to an exemplary embodiment. Portable electronic device 150 is shown as a smartphone; however, it should be understood that portable electronic device may also be a tablet, a PDA, a portable media player, a laptop, or another portable electronic device. Portable electronic device 150 may be used to store various types of media files. For example, portable electronic device 150 is shown as including a photos application for storing digital photos, a music application for storing digital music, and a video application for storing digital videos. Portable electronic device 150 may be used to create digital media. For example, portable electronic device 150 is shown as including a camera application for capturing digital pictures and videos through a camera of portable electronic device 150 and an audio recorder application for recording audio clips. Additionally, the user may download media through the application store, the music store, the web browser, or the like. Any created or downloaded media may be stored in the memory of portable electronic device 150 or may be uploaded to a server for networked access (i.e., uploaded to the cloud for on-demand retrieval through a data connection of portable electronic device 150).

A player of gaming machine 102 may connect portable electronic device 150 to electronic gaming machine 102 or game server 160 such that the player can upload various media to gaming machine 102 or game server 160 for customizing the gaming experience on gaming machine 102. The media may be transmitted directly from portable electronic device 150 to gaming machine 102 or game server 160 if the media is stored locally in memory of portable electronic device 150. Alternatively, portable electronic device 150 may provide access to media located on a user account remote from portable electronic device (e.g., media stored remotely through a cloud storage service such as Google Drive). The media may then be output to the player during game play on the gaming machine. As discussed in further detail below, the uploaded media may be inserted into the game presented on gaming machine 102 such that the media is output as gaming symbols, gaming sounds, and/or non-gaming background elements.

Figure 3:
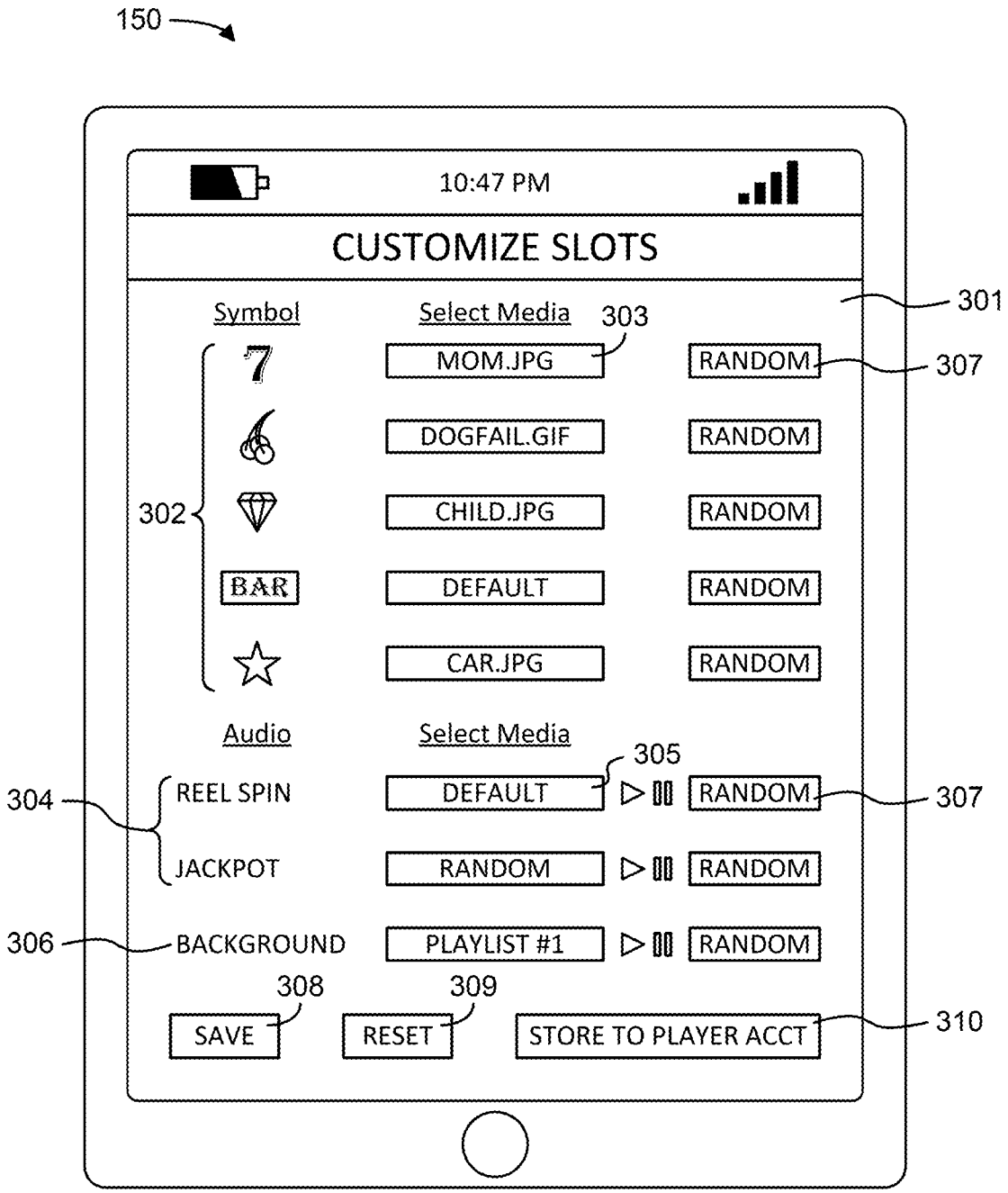
FIG. 3 is a view of a user interface presented on a portable electronic device according to an exemplary embodiment.

Referring to FIG. 3, a view of a customization interactive graphical user interface 301 is shown on display 151 of portable electronic device 150. User interface 301 allows the player to customize the game play experience for a slot game presented on gaming machine 102. User interface 301 may be presented as part of a casino application (e.g., a smartphone application). The casino application, when executed, allows the player to pair portable electronic device 150 with gaming machine 102 or with game server 160. Alternatively, user interface 301 may be accessible through a website. The website may become accessible to the player only after the player pairs portable electronic device 150 with gaming machine 102 or with game server 160. The website may be hosted on gaming machine 102, game server 160, or another component of a gaming network. Alternatively, the website may be hosted on a remote server accessible through the Internet such that the website is also accessible outside of the gaming environment. In such an arrangement, the user can access the website regardless of the pairing status of portable electronic device 150.

User interface 301 presents the player a listing of symbols 302 that may be substituted during game play. Here, the player may customize the slot game by substituting a custom media file for any of the listed symbols 302. The player may substitute a media file having a supported format. The media file may be stored in the memory of portable electronic device 150 or on a remote server accessible through portable electronic device 150. If the player wishes to substitute any of symbols 302 for custom media, the user interacts with button 303 of user interface 301. Player interaction with button 303 may present the player a drop down menu automatically populated with identified supported media found in memory of portable electronic device 150, an explorer window such that the player can navigate to the desired media stored in the memory of portable electronic device 150, a search bar such that the player can search for media by name, or another suitable file locator. As shown in FIG. 3, the user has substituted each symbol 302 with a custom media file. The media file may be any supported media file, such as a static image (e.g., "MOM.JPG"), an animation (e.g., DOGFAIL.gif), or a video file. In the event the player selects an animation or a video file, the animation or video may play as the custom symbol is presented on gaming machine 102. The playback may be looped playback or the playback may stop after the duration of the video or animation is reached. The playback may include audio that is played in conjunction with the normal game sounds presented by gaming machine 102.

Still referring to FIG. 3, user interface 301 allows the player to customize the audio presented to the player by gaming machine 102 during game play of the slot game. User interface 301 presents the player a listing of game sound 304 that may be customized for game play by the player. The player may select a customized audio file for gaming machine 102 to present in place of the default game sounds 304. The selected customized audio file may be a supported media file. The media file may be stored in the memory of portable electronic device 150 or on a remote server accessible through portable electronic device 150. If the player wishes to substitute any of the standard game sounds 304 for custom media, the user interacts with button 305 of user interface 301. Player interaction with button 305 may present the player a drop down menu automatically populated with identified supported media found in memory of portable electronic device 150, an explorer window such that the player can navigate to the desired media stored in the memory of portable electronic device 150, a search bar such that the player can search for media by name, or another suitable file locator. The selected media file may be any supported audio media file (e.g., .wav, .mp3, ma, .mid, .mpg, .m4a, etc.). In some arrangements, the selected media file may be a video file, in which case the audio track of the video file will be played if selected by the user. User interface 301 allows the player to preview a selected media file by interacting with displayed play and pause buttons.

Additionally, the user interface 301 allows the player to select a background music 306 for playback during game play on gaming machine 102. Interaction with the appropriate button 305 allows the user to configure background music 306 for game play on gaming machine 102. The user may select an already created playlist (e.g., a playlist created in iTunes and stored on the memory of portable electronic device 150). Alternatively, interaction with button 305 allows the user to create a playlist based on music stored in the memory of portable electronic device 150 or on a remote server accessible through portable electronic device 150. In yet another alternative, the user may also select from a listing of radio stations. The radio stations may include radio stations that are broadcast over the air and captured by a radio tuner located on gaming machine 102 or connected to game server 160. The radio stations may include Internet radio stations (e.g., Pandora, Slacker, Radio.com, etc.).

Still referring to FIG. 3, user interface 301 includes random button 307 for each customizable image or audio file. Each random button 307 selects a random media file for substitution over the default media file. The random media file selected will then be substituted for the default media file during game play of gaming machine 102. In some arrangements, the random media file selected by the system remains substituted for the entire duration of game play by the player. In other arrangements, the system intermittently or continuously selects new random media files for substitution. For example, if the player selects a random file for the jackpot, as shown in FIG. 3, the first time a jackpot is won, a first random file will be played, the second time a jackpot is won, a second random file will be played, and so on.

After the user has finished customizing the game through user interface 301, the user interacts with the bottom pane of user interface 301. The bottom pane includes save button 308, reset button 309, and store to player account button 310. Save button 308 saves the settings input by the player into user interface 301. Upon selecting save button 308, portable electronic device 150 transmits the customized game settings to game server 160 or to gaming machine 102 such that gaming machine 102 presents the slot game with the player's customizations. Reset button 309 returns all player customizations back to default game settings. Accordingly, upon selecting reset button 309, user interface 301 resets all customization options back to the default game settings and instructs game server 160 or to gaming machine 102 to revert back to the default game presentation settings. Store to player account button 310 stores customized game settings to a player account such that the settings are automatically loaded when the player signs into a gaming machine. The player account settings may be stored on game server 160.

Figure 4:
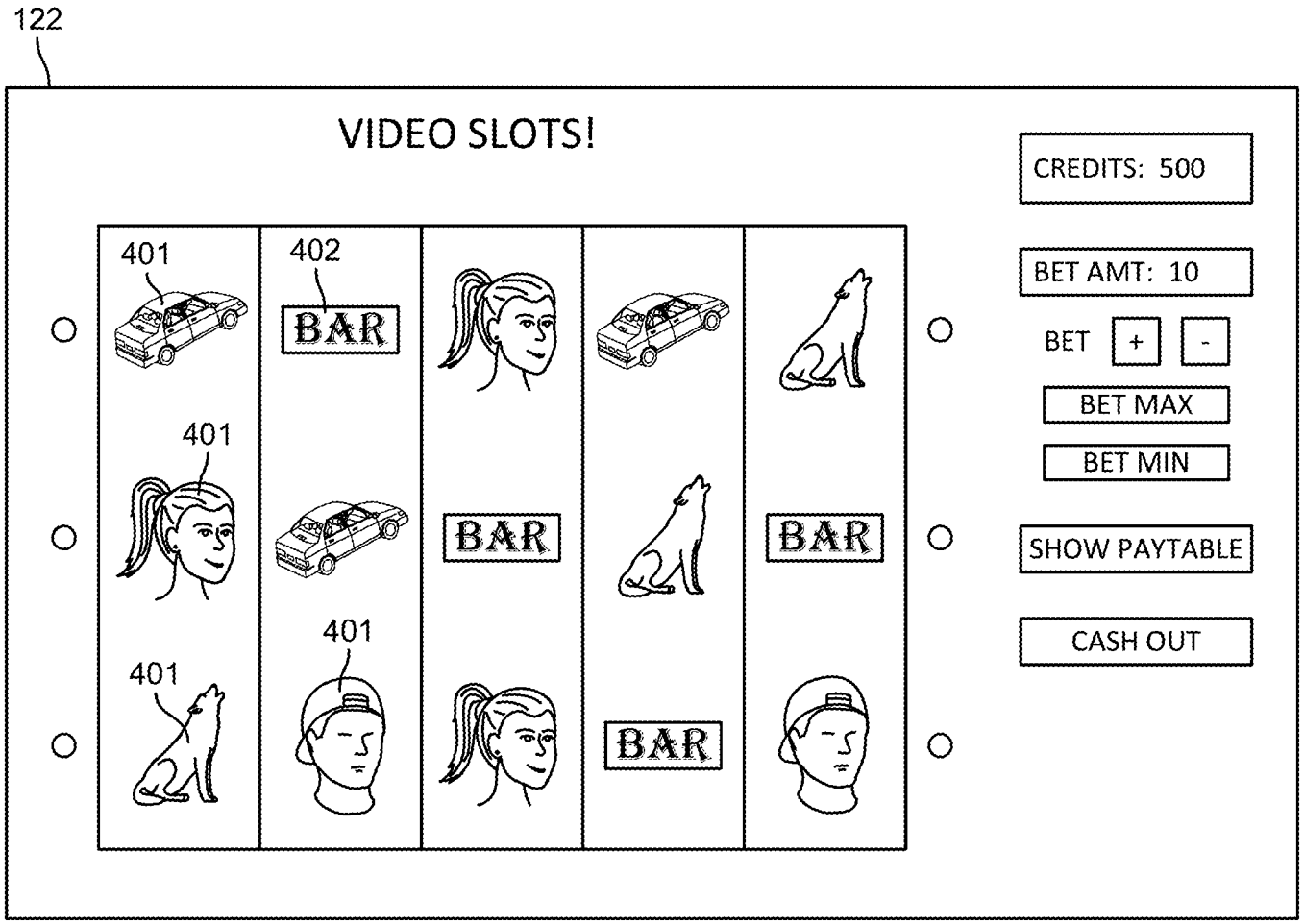
FIG. 4 is a view of a customized video slot game presented on a gaming machine according to the customizations of the user interface of FIG. 3.

Referring to FIG. 4, a view 400 of a slot game presented on display 122 of gaming machine 102 is shown according to the player customizations presented on user interface 301 of FIG. 3. In the presentation of the slot game, user provided media 401 is displayed on the slot reels along with any default symbols 402 that the user did not substitute.

Figure 5:
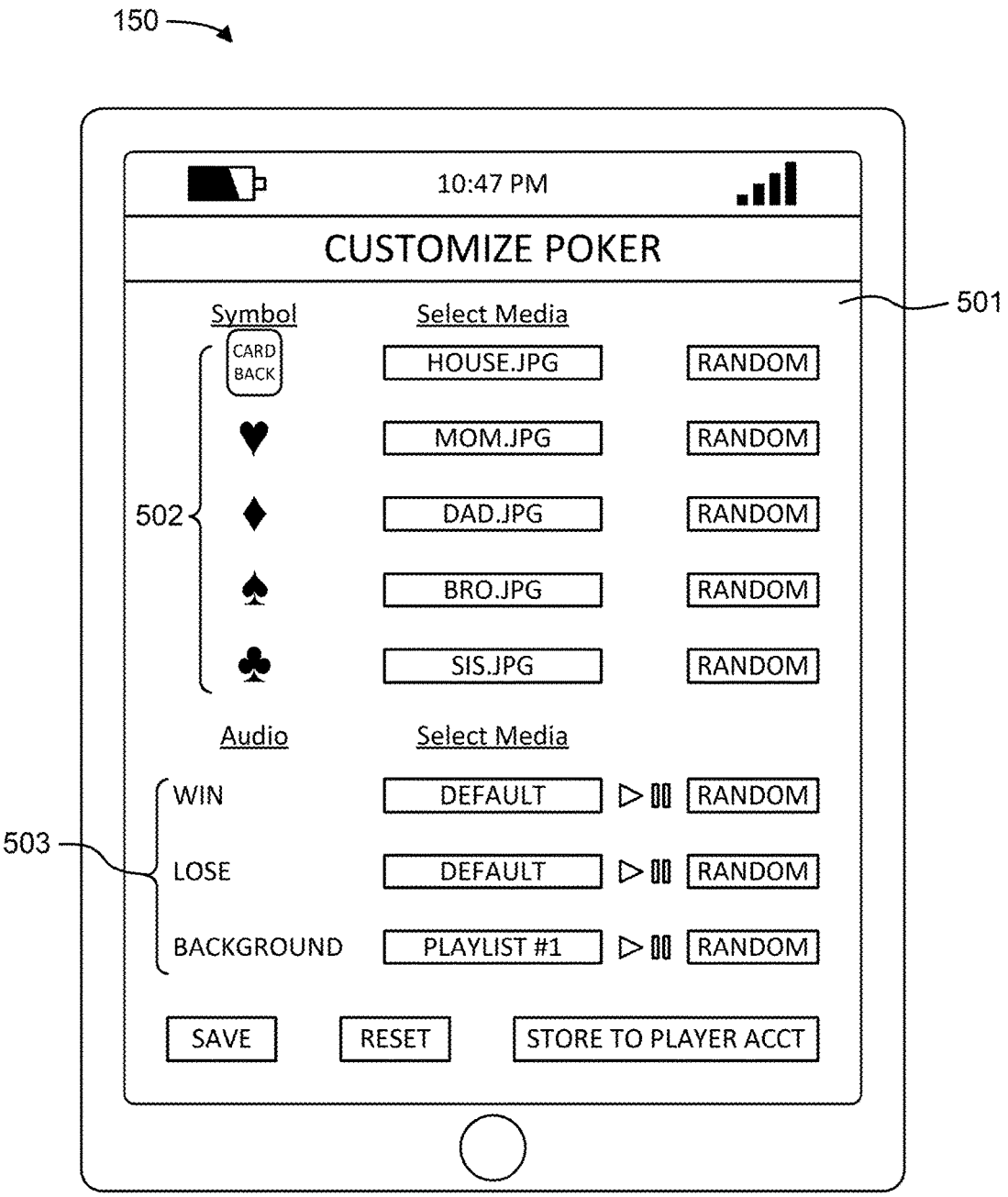
FIG. 5 is a view of a user interface presented on a portable electronic device according to an exemplary embodiment.

Referring to FIG. 5, a view of a customization interactive graphical user interface 501 is shown on display 151 of portable electronic device 150. User interface 501 is similar to user interface 301. User interface 501 allows the player to customize the game play experience for a video poker game presented on gaming machine 102. The main differences between user interface 501 and user interface 301 relate to the differences between the video slot game and the video poker game. User interface 501 may be presented as part of a casino application (e.g., a smartphone application). The casino application, when executed, allows the player to pair portable electronic device 150 with gaming machine 102 or with game server 160. Alternatively, user interface 501 may be accessible through a website. The website may become accessible to the player only after the player pairs portable electronic device 150 with gaming machine 102 or with game server 160. The website may be hosted on gaming machine 102, game server 160, or another component of a gaming network. Alternatively, the website may be hosted on the Internet such that the website is accessible outside of the gaming environment such that the user can access the website regardless of the pairing status of portable electronic device 150.

Similar to user interface 301, user interface 501 allows the player to substitute default symbols 502 of the video poker game with custom media in the same manner as described above with respect to user interface 301. Further, user interface 501 allows the player to substitute default audio 503 of the video poker game with custom media in the same manner as described above with respect to user interface 301. The custom media may be a supported media file format. The custom media file may be stored in the memory of portable electronic device 150 or on a remote server accessible through portable electronic device 150. The player can navigate, search for, and select the custom media files in the same manner as discussed above with respect to user interface 301. Further, user interface 501 includes a bottom pane having the same arrangements of buttons of the bottom pane of user interface 301, which allow the player to save the custom settings, reset the settings to the game default, and store the custom settings in an associated player account.

Figure 6:
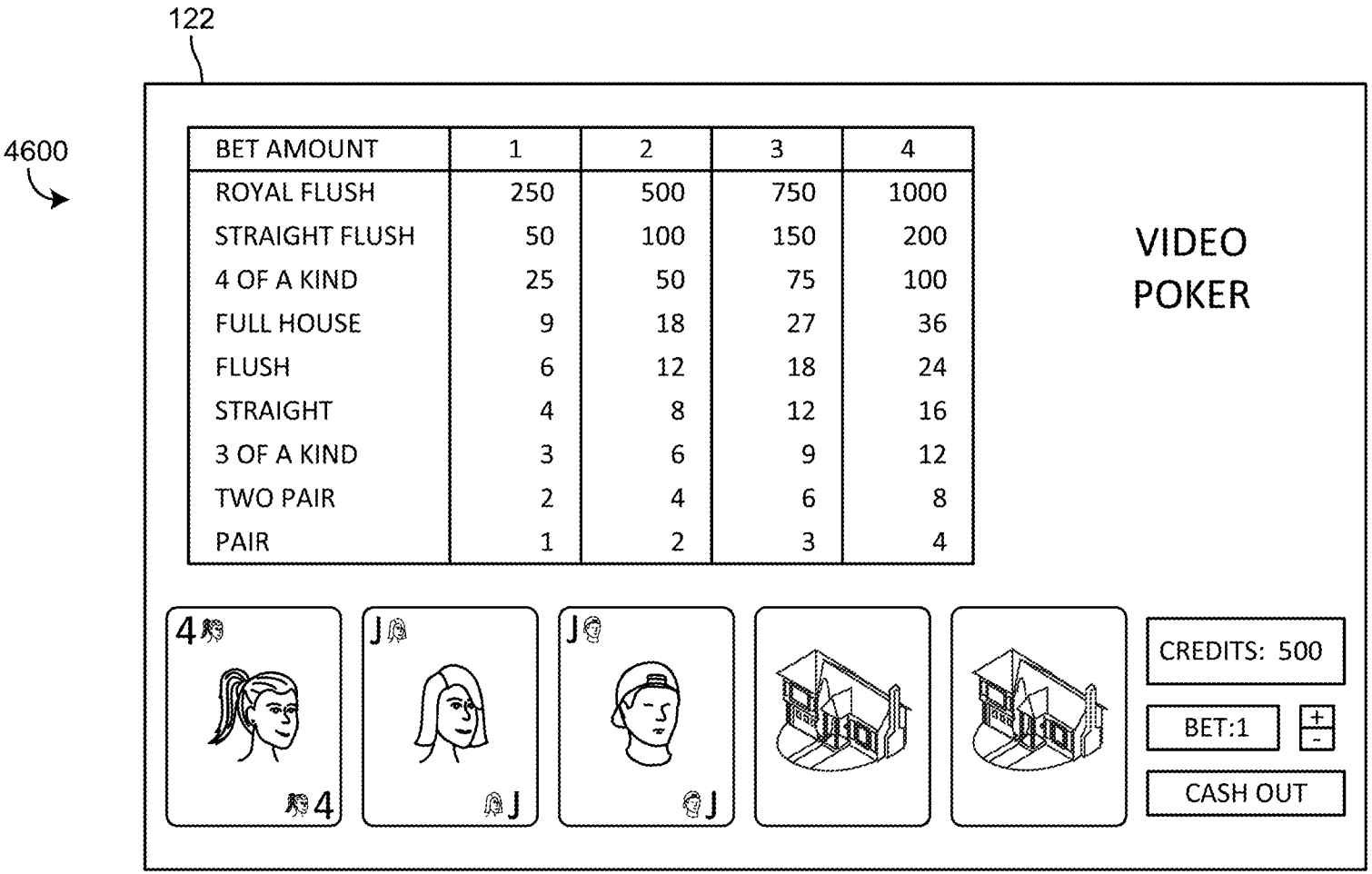
FIG. 6 is a view of a customized video poker game presented on a gaming machine according to the customizations of the user interface of FIG. 5.

Referring to FIG. 6, a view 600 of a video poker game presented on display 122 of gaming machine 102 is shown according to the player customizations presented on user interface 501 of FIG. 6. In the presentation of the slot game, user provided media is displayed on the slot reels along with any default symbols that the user did not substitute.

Figure 7:
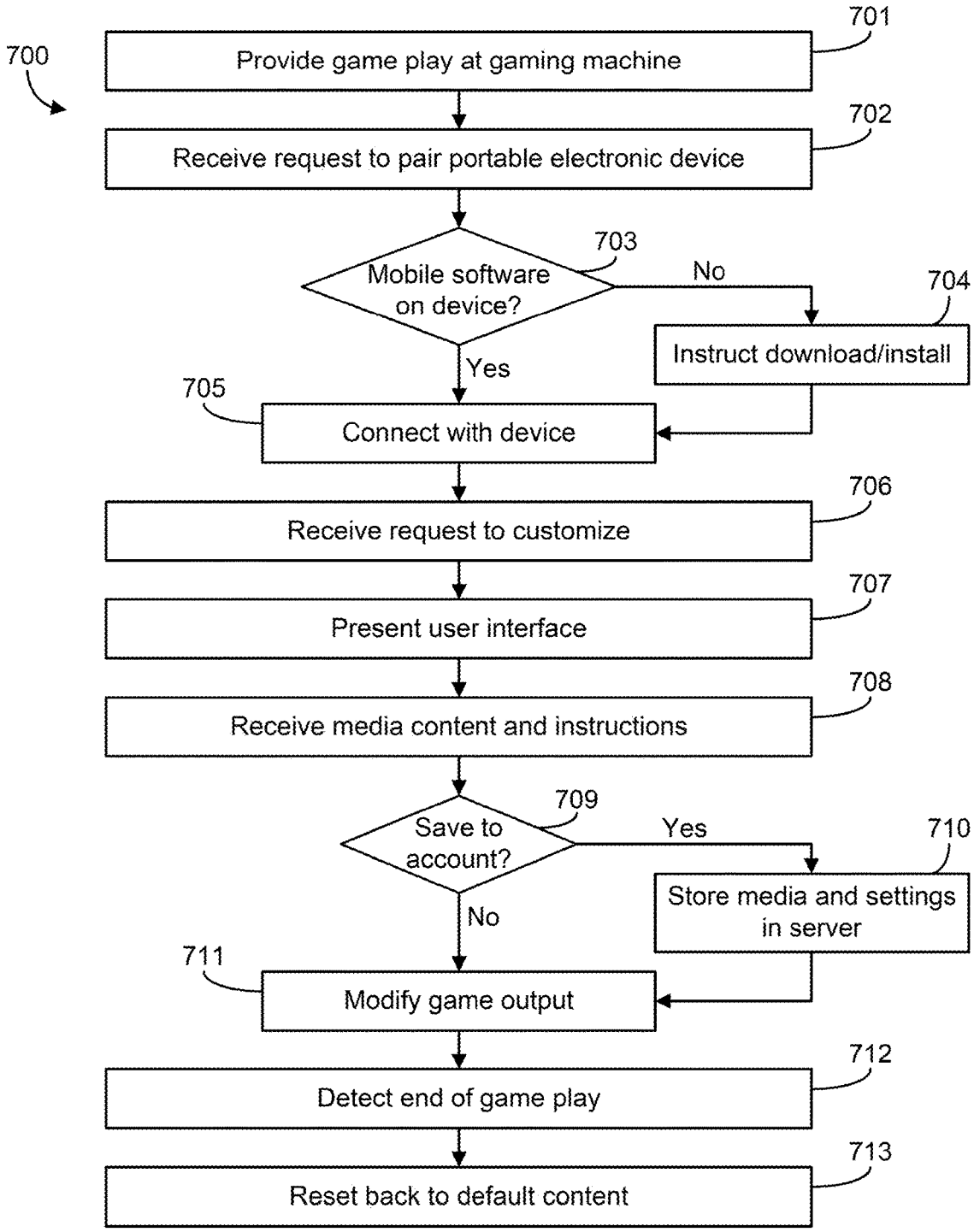
FIG. 7 is a flow diagram of a method of customizing elements of game play on a gaming machine according to an exemplary embodiment.

Referring to FIG. 7, a flow diagram of method 700 within a gaming system including gaming machine (e.g., gaming machine 102) and optionally including gaming server (e.g., server 160) is shown according to an exemplary embodiment. Method 700 generally relates to customizing game play on a gaming machine (e.g., gaming machine 102) via a player's mobile device (e.g., portable electronic device 150).

A gaming machine is configured to provide game play to a player (step 701). The gaming machine may execute the game code locally, in which case the remaining steps are performed by the gaming machine. Alternatively, the gaming machine may function as a thin client having at least a portion of the gaming code executed remotely on a gaming server, in which case the remaining steps are performed by the gaming machine, the gaming server, or a combination of both. The game code relates to a game offered for play to a player. The game may be a wager-based game. The game may be customizable with player provided content. As discussed above, the player provided content may relate to image data, video data, and/or audio data that is provided to the gaming system via the player's portable electronic device. The player provided content is then used in place of default gaming content, which provides the player a customized game play experience on the gaming machine.

The gaming machine receives a request to pair a portable electronic device to the gaming system (e.g., to the gaming machine or to the gaming server) from the player (step 702). The request may be received through an input of the gaming machine (e.g., the player presses a button to pair a portable electronic device with the gaming system). Alternatively, the request is received from the portable electronic device through a network connection between the device and the gaming system. After receipt of the request, the gaming system determines whether the portable electronic device has the appropriate application installed necessary to enable the portable electronic device to interface with the gaming system (step 703). If the gaming system determines that the portable electronic device does not have the application installed, the gaming system instructs the player to download and install the application on the portable electronic device (step 704). In an exemplary embodiment, the gaming system may display a message on the display of the gaming machine. The message directs the player to a download location of the application (e.g., an application store accessible through the internet, a website containing an installation file for the application, a shared folder on a local network accessible by the portable electronic device, etc.). The displayed message may include machine readable code such as a barcode or a two-dimensional barcode (e.g., a QR code) that is scannable by a camera of the portable electronic device. After the portable electronic device scans the code, the portable electronic device is directed to a download location for the application.

After the gaming system verifies that the portable electronic device has the application installed, the gaming system connects with the portable electronic device (step 705). The connection is made through a wired connection (e.g., USB, Ethernet, etc.) or a wireless connection (e.g., 802.11, Bluetooth, Zigbee, infrared, etc.). In some configurations, the portable electronic device connects directly to the gaming machine. In other configurations, the portable electronic device connects to a gaming server. In some arrangements, the portable electronic device may have been previously connected to the gaming system with limited capability (e.g., to download the application). In such an arrangement, the application provides a greater level of access to the portable electronic device to the gaming system.

After connecting the portable electronic device to the gaming system, the gaming system receives a request to customize game play from the player (step 706). The request may be received through the connected portable electronic device. For example, the player may interact with a user interface of a system application being executed on the portable electronic device to send a customization command to the gaming system. Alternatively, the command may be received through user interaction with the gaming machine. For example, the gaming machine may present the user the option to customize game play through an onscreen menu displayed on the gaming machine (e.g., displayed via display 122 of gaming machine 102). The request may come prior to the start of a game play session or during a game play session on the gaming machine.

After receiving the request, the gaming system presents a user interface (e.g., user interface 301 or user interface 501) on the player's portable electronic device (step 707). The user interface allows the player to customize game play on the gaming machine. As discussed above with respect to FIG. 3 and FIG. 5, the player may substitute player provided media files for default media files used during presentation of the game on gaming machine through the user interface. For example, the player may substitute a picture of a friend for a symbol on a slot game. The player provided media files may be located in a memory of the portable electronic device or in a cloud storage system accessible through the portable electronic device.

After the player indicates the customization information through the user interface, the gaming system receives media content and customization settings from the player's portable electronic device (step 708). The media content may be image files, animation files, video files, and/or audio files. The media content is transferred from portable electronic device to the gaming machine or the gaming server.

After receiving the media and customization settings, the system determines whether the media and customization settings are to be stored and associated with the player's player account (step 709). As discussed above with respect to FIG. 3 and FIG. 5, the player may store the customized game settings in the player's player account (e.g., a casino loyalty account) such that the customized settings can be used during another gaming session on another gaming machine without having to input the customization settings and media again. If the settings and media are to be stored, the system stores the media and settings (step 710). The media and settings are stored in a player account database and associated with the player's individual account. Accordingly, should the player decide to switch machines or start a new gaming session at a later point, the customized settings and media can be retrieved when the player signs into his player account.

If the settings and media are not to be stored, or after the settings and media have been stored, the gaming system presents game play on the gaming machine according to the customized settings and provided media content (step 711). As discussed above with respect to FIG. 4 and FIG. 6, the player provided media content may be substituted for default media content used during the presentation of the game on the gaming machine. Any player customizations do not affect the outcome of the game (e.g., odds, paytable, game rules, etc.). Accordingly, the player customizations do not require regulatory approval prior to allowing game play on the gaming system. As the media files and customization settings have been transferred to the gaming machine, the gaming server, or both, the customized game play will continue until the end of game play by the player. A constant connection between the portable electronic device and the gaming system is not needed after the media files and customization settings have been transferred to the gaming system. Accordingly, if a break in the connection between the portable electronic device and the gaming system, the gaming machine will continue to present the game according to the player customizations until the end of game play (as determined in step 712).

The system detects the end of game play on the gaming machine by the player (step 712). The player may indicate that game play has ended when the player performs a cash-out function on the gaming machine, when a zero credit balance remains on the gaming machine, or when the player removes a player loyalty card from the gaming machine. After the gaming session ends, the gaming system ends the connection between the gaming system and the portable electronic device and the gaming system reverts to the default game presentation settings (step 713). Reverting the gaming presentation back to default includes restoring all default media files, including image, video, and audio media files. Additionally, the gaming system may delete any player provided media files if the media files are not to be associated with the player's player account. Once the gaming system reverts to the default game presentation settings, the gaming system enables game play available for another player and method 700 ends.

Figure 8:
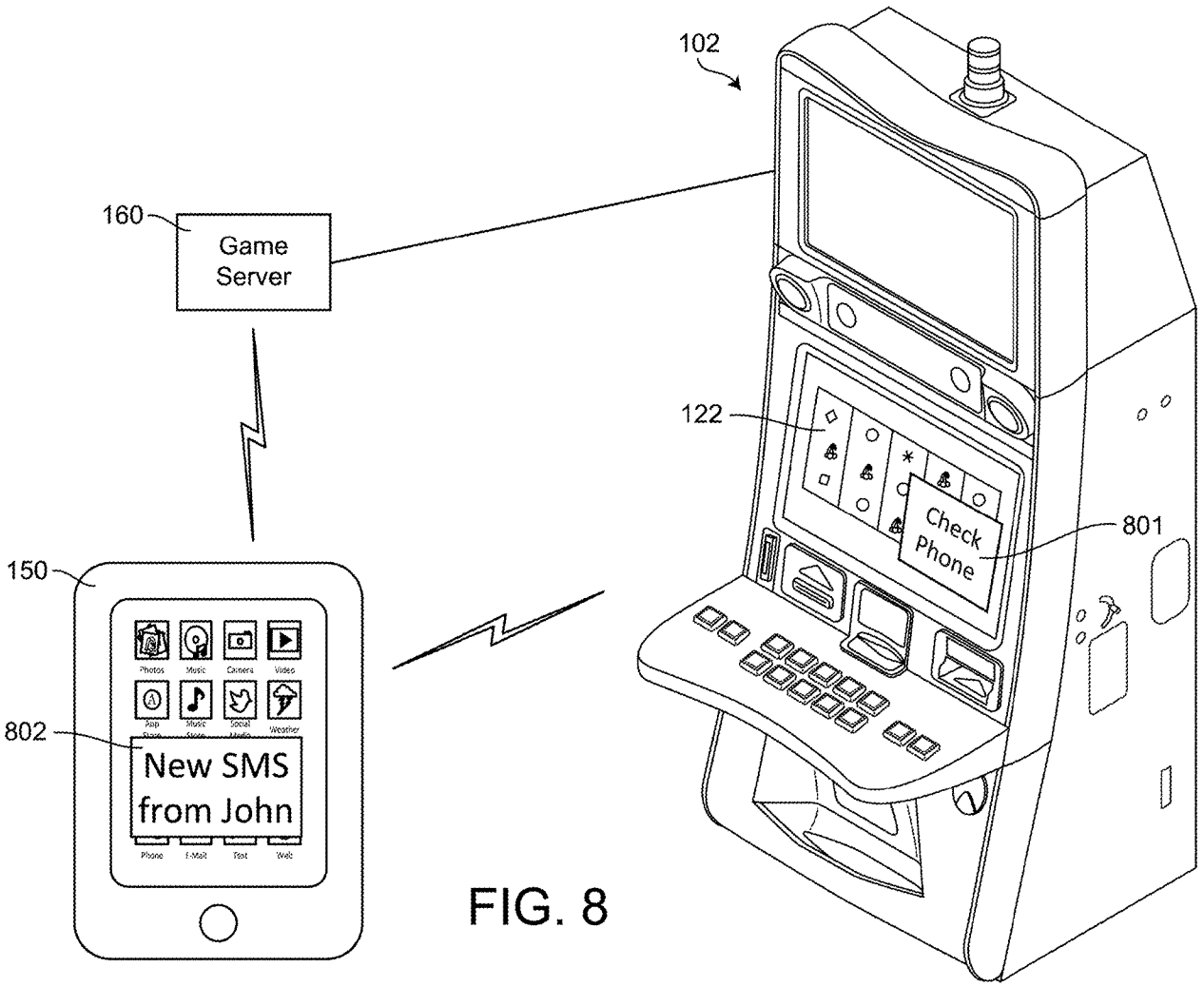
FIG. 8 is a perspective view of a gaming system according to an exemplary embodiment.

Referring to FIG. 8, gaming machine 102 is shown according to an exemplary embodiment. After connecting portable electronic device 150 to gaming system 100, a player can opt to have gaming machine 102 display notifications 801 relating to a status of portable electronic device 150 through display 122. Often times, gaming machines, such as gaming machine 102, are located in loud areas (e.g., airport terminals, casino gaming floors, malls, etc.). Accordingly, if notification 802, shown as a new text message indicator, is received on portable electronic device 150, the player may not hear the notification audio alert or feel portable electronic device 150 vibrate. Accordingly, notification 801 serves to direct the player's attention to portable electronic device 150. The player may opt in to receiving in-game alerts displayed on display 122 through a customized setting input into an application running on portable electronic device 150. Alternatively, the player may opt in to receiving in-game alerts through a menu presented on display 122 of gaming machine 102.

Notification 801 may relate to a received voicemail, incoming calls, social media alerts, e-mails, text messages, application push notifications, or the like. Notification 801 may be a generic alert. For example, as shown in FIG. 8, notification 801 states "CHECK PHONE" alerting the player of gaming machine 102 to check his phone. Alternatively, notification 801 can specify the type of notification received on portable electronic device 150. For example, notification 801 may state "NEW SMS FROM JOHN" (as shown in notification 802), "INCOMING PHONE CALL," or the like. Still further, notification 801 may include content of the notification received on portable electronic device 150. For example, notification 801 may state "NEW SMS FROM JOHN: Are you winning? What time are we meeting for dinner?"

As shown in FIG. 8, notification 801 is a one-way notification meaning the player cannot interact with notification 801. In an alternative arrangement, gaming machine 102 allows the player to interact with the notification. For example, if notification 802 relates to a text message or e-mail, gaming machine 102 may allow the player to click on notification 801 to bring up an onscreen keyboard such that the player can respond to the text message. Any typed reply is then sent to portable electronic device 150 by the gaming system (via gaming machine 102 or via game server 160) such that the reply can be transmitted by portable electronic device 150. As an additional example, if notification 802 relates to a MMS message, gaming machine 102 may allow the player to click on notification 801 to display the attached media file on display 122 of gaming machine 102. As yet another example, if notification 802 relates to a received voicemail, gaming machine 102 may allow the player to click on notification 801 to play the contents of the voicemail through speakers 126 of gaming machine 102 (e.g., by clicking on a play button displayed within notification 801).

Figure 9:
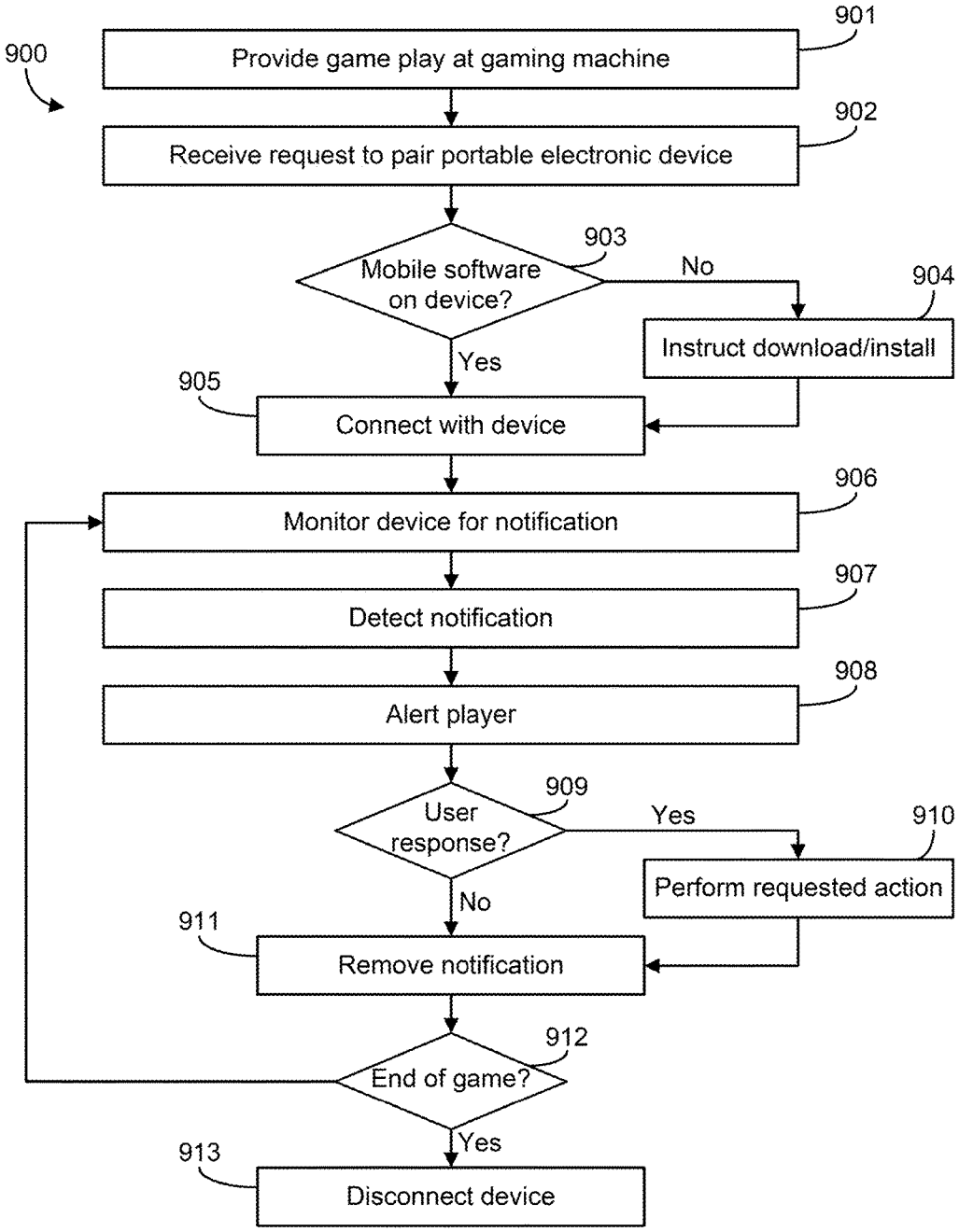
FIG. 9 is a flow diagram of a method of displaying a notification at a gaming machine based on a notification received at a connected portable electronic device according to an exemplary embodiment.

Referring to FIG. 9, a flow diagram of method 900 within a gaming system including gaming machine (e.g., gaming machine 102) and optionally including gaming server (e.g., server 160) is shown according to an exemplary embodiment. Method 900 generally relates to presenting a notification (e.g., notification 801) to a player via a gaming machine display (e.g., display 122 of gaming machine 102) relating to a notification (e.g., notification 802) received on the player's mobile device (e.g., portable electronic device 150).

A gaming machine is configured to provide game play to a player (step 901). The gaming machine may execute the game code locally, in which case the remaining steps are performed by the gaming machine. Alternatively, the gaming machine may function as a thin client having at least a portion of the gaming code executed remotely on a gaming server, in which case the remaining steps are performed by the gaming machine, the gaming server, or a combination of both. The game code relates to a game offered for play to a player. The game may be a wager-based game.

The gaming machine receives a request to pair a portable electronic device to the gaming system (e.g., to the gaming machine or to the gaming server) from the player (step 902). The request may be received through an input of the gaming machine (e.g., the player presses a button to pair a portable electronic device with the gaming system). Alternatively, the request is received from the portable electronic device through a network connection between the device and the gaming system. After receipt of the request, the gaming system determines whether the portable electronic device has the appropriate application installed necessary to enable the portable electronic device to interface with the gaming system (step 903). If the gaming system determines that the portable electronic device does not have the application installed, the gaming system instructs the player to download and install the application on the portable electronic device (step 904). In an exemplary embodiment, the gaming system may display a message on the display of the gaming machine. The message directs the player to a download location of the application (e.g., an application store accessible through the internet, a website containing an installation file for the application, a shared folder on a local network accessible by the portable electronic device, etc.). The displayed message may include machine readable code such as a barcode or a two-dimensional barcode (e.g., a QR code) that is scannable by a camera of the portable electronic device. After the portable electronic device scans the code, the portable electronic device is directed to a download location for the application.

After the gaming system verifies that the portable electronic device has the application installed, the gaming system connects with the portable electronic device (step 905). The connection is made through a wired connection (e.g., USB, Ethernet, etc.) or a wireless connection (e.g., 802.11, Bluetooth, Zigbee, infrared, etc.). In some configurations, the portable electronic device connects directly to the gaming machine. In other configurations, the portable electronic device connects to a gaming server. In some arrangements, the portable electronic device may have been previously connected to the gaming system with limited capability (e.g., to download the application). In such an arrangement, the application provides a greater level of access to the portable electronic device to the gaming system.

After connecting the portable electronic device to the gaming system, the gaming system monitors the portable electronic device for notifications (step 906). The notification may relate to received voicemails, incoming calls, social media alerts, received e-mails, received text messages, application push notifications, or the like. Any notification received on the portable electronic device that triggers an alert output on the portable electronic device (e.g., an audio alert, a vibration alert, a screen on alert, a notification LED, or a combination there of) may be monitored for by the gaming system.

While monitoring the portable electronic device for notifications, the gaming system detects a notification on the player's portable electronic device (step 907). After detecting the notification, the gaming system alerts the player (step 908). The gaming system may alert the player by displaying a notification (e.g., notification 801) on the display of the gaming machine. The displayed notification may be accompanied by an audible alert (e.g., a tone, a series of beeps, an audio voice message, etc.) and/or a lighting effect (e.g., flashing of the screen, flashing of a light array, etc.).

The gaming system determines whether the user responds to the presented notification (step 909). If the user responds, the gaming system performs the requested action (step 910). In some arrangements, the notification presented to the player via the gaming machine is interactive. For example, if the notification relates to a text message or e-mail, the gaming machine may allow the player to interact with the notification. If the player interacts with the notification, the gaming machine may present an onscreen keyboard if the gaming machine display is a touchscreen. Accordingly, the player can respond to the text message without direct interaction with the portable electronic device. Any typed reply is then sent to the portable electronic device by the gaming system such that the reply can be transmitted by the portable electronic device to the appropriate recipient or application. As an additional example, if the notification relates to a voicemail, the player can interact with the notification to play the voicemail through the speakers of the gaming machine. If the user does not respond, or after action has been performed, the notification is removed from the display of the gaming machine such that the player can continue playing the game (step 911).

The gaming system determines whether game play by the player has ended (step 912). The player may indicate that game play has ended when the player performs a cash-out function on the gaming machine, when a zero credit balance remains on the gaming machine, or when the player removes a player loyalty card from the gaming machine. If game play has not ended, the method returns to step 906. If game play has ended, the gaming system ends the connection between the gaming system and the portable electronic device (step 913).

The above discussed systems methods of customizing game play and providing notifications through the gaming machine may be used together. For example, a player may customize game play on a video slot machine by connecting his cell phone to the gaming machine and providing media to the gaming machine. During game play of the customized slot machine, the player's cell phone remains connected to the gaming machine, and the cell phone receives a text message. A notification may be displayed on the gaming machine alerting the player to the received text message.

During game play, the connection between portable electronic device 150 gaming system 100 may be unexpectedly disconnected. If the user has already provided customization settings and the necessary media files, the customized game play will continue until the end of game play is detected. In some arrangements, the gaming machine may be configured to present an indication to the player that the disconnection has occurred. For example, gaming machine 102 may display a message on display 122 requesting that the player reconnect the portable electronic device to the gaming system. Alerting the player to the unexpected disconnection may help the player avoid missing notifications on the portable electronic device if the player has opted into receiving portable electronic device notifications via the gaming machine.

The above discussed systems and methods of customizing game play with custom media may be modified for use without portable electronic device 150. For example, a player having a player account with a casino may use a home computer connected to the casino's player account server (e.g., through a casino website accessed via the Internet) to upload customization settings and media that are associated with the player's account. In this example, when the player signs into his account at an electronic gaming machine (e.g., by inserting his player loyalty card into a card reader of gaming machine 102), the gaming system automatically customizes game play. Further, gaming system 100 may offer custom media that is preloaded onto the gaming machine such that the player can customize the game play experience without having pairing portable electronic device 150 and/or without having custom media and settings associated with the player's account. For example, a casino may have a licensing deal with a sports league that lets casino patrons customize game play with team and league logos and/or sounds. In this example, the team and league logos and/or sounds may be accessible by the player without requiring a portable electronic device and/or a player account.

In order to use any of the above customization or portable electronic device notification features, the player may need to be eligible. A player's eligibility to use these features may require payment of a fee. For example, the player can pay an additional amount of credits to insert customized images or audio into game play of a gaming machine or to present portable electronic device alerts via the gaming machine display. The credits paid may be good for a certain number of game cycles or a designated duration of time. In another alternative arrangement, the player may earn eligibility through play of the game. In yet another alternative, the gaming establishment may limit player eligibility to players participating in a player loyalty program. In such an arrangement, the player's status in the player loyalty program may affect the number of customization and/or alert options. For example, a gold level player may have a higher number of customizations available than a bronze level player.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing agent. Alternatively or in addition, the program instructions can be encoded on an artificially-generated propagated signal, e.g., a machine-generated electrical, optical, or electromagnetic signal, that is generated to encode information for transmission to suitable receiver agent for execution by a data processing agent. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing agent on data stored on one or more computer-readable storage devices or received from other sources.

The term "client or "server" include all kinds of agent, devices, and machines for processing data, including by way of example a programmable processor, a computer, a system on a chip, or multiple ones, or combinations, of the foregoing. The agent can include special purpose logic circuitry, e.g., an FPGA (field programmable gate array) or an ASIC (application-specific integrated circuit). The agent can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The agent and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and agent can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

It should further be noted that for purposes of this disclosure, the term "couple" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or, alternatively, may be removable or releasable in nature.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

The invention is claimed as follows:

1. An electronic gaming machine comprising:

at least one display device;

a plurality of input devices including a payment acceptor;

at least one processor; and at least one memory device which stores a plurality of instructions, which when executed by the at least one processor, cause the at least one processor to:

responsive to a physical item being received via the payment acceptor, establish a credit balance based, at least in part, on a monetary value associated with the received physical item, wherein said physical item is selected from the group consisting of: a ticket associated with the monetary value and a unit of currency, responsive to a designated mobile device application being installed on a mobile device, and data associated with a customization setting comprising a custom media file being wirelessly received from the mobile device in association with the designated mobile device application:

customize an interface of the electronic gaming machine by substituting default media content associated with a default interface of a default setting of the electronic gaming machine with custom media content of the custom media file of the customization setting associated with the data wirelessly received from the mobile device, and upon a placement of a wager amount which causes a decrease of an amount of the credit balance, cause the at least one display device to display a first play of a wagering game which utilizes the customized interface to present the custom media content, responsive to no data associated with the customization setting being received from the mobile device and upon the placement of the wager amount which causes the decrease of the amount of the credit balance, cause the at least one display device to display a second, different play of the wagering game, which utilizes the default interface to present the default media content which is different than the custom media content, and responsive to a cashout input being received, cause an initiation of any payout associated with the credit balance.

2. The electronic gaming machine of claim 1, wherein when executed by the at least one processor responsive to a request to pair the mobile device being received and the designated mobile device application not being installed on the mobile device, the plurality of instructions cause the at least one processor to cause the at least one display device to display an instruction to download the designated mobile device application to the mobile device.

3. The electronic gaming machine of claim 2, wherein the displayed instruction includes a machine readable code.

4. The electronic gaming machine of claim 1, wherein when executed by the at least one processor, the plurality of instructions cause the at least one processor to associate the customization setting with a player account of a player.

5. The electronic gaming machine of claim 1, wherein when executed by the at least one processor, the plurality of instructions cause the at least one processor to revert to the default setting upon a determination to cease utilizing the customization setting.

6. The electronic gaming machine of claim 1, wherein the custom media file is stored by the mobile device prior to being wirelessly received from the mobile device in association with the designated mobile device application.

7. The electronic gaming machine of claim 1, wherein the custom media content is selected from the group consisting of: a symbol associated with the first play of the wagering game, a sound associated with the first play of the wagering game, and a background element associated with the first play of the wagering game.

8. A system comprising:

at least one processor; and at least one memory device which stores a plurality of instructions, which when executed by the at least one processor, cause the at least one processor to:

responsive to a designated mobile device application being installed on a mobile device, and data associated with a customization setting comprising a custom media file being wirelessly received from the mobile device in association with the designated mobile device application:

customize an interface by substituting default media content associated with a default interface of a default setting with custom media content of the custom media file of the customization setting associated with the data wirelessly received from the mobile device, and cause a display, by a display device, of the customized interface presenting the custom media content, and responsive to no data associated with the customization setting being received from the mobile device, cause a display, by the display device, of the default interface presenting the default media content which is different than the custom media content.

9. The system of claim 8, wherein when executed by the at least one processor responsive to a request to pair the mobile device being received and the designated mobile device application not being installed on the mobile device, the plurality of instructions cause the at least one processor to cause the at least one display device to display an instruction to download the designated mobile device application to the mobile device.

10. The gaming system of claim 9, wherein the displayed instruction includes a machine readable code.

11. The system of claim 8, wherein when executed by the at least one processor, the plurality of instructions cause the at least one processor to associate the customization setting with a player account of a player.

12. The system of claim 8, wherein when executed by the at least one processor, the plurality of instructions cause the at least one processor to revert to the default setting upon a determination to cease utilizing the customization setting.

13. The system of claim 8, wherein the custom media file is stored by the mobile device prior to being wirelessly received from the mobile device in association with the designated mobile device application.

14. The system of claim 8, wherein the custom media content is selected from the group consisting of: a symbol, a sound, and a background element.

15. A method of operating an electronic gaming machine, said method comprising:

responsive to a designated mobile device application being installed on a mobile device, and data associated with a customization setting comprising a custom media file being wirelessly received from the mobile device in association with the designated mobile device application:

customizing, by a processor, an interface of the electronic gaming machine by substituting default media content associated with a default interface of a default setting of the electronic gaming machine with custom media content of the custom media file of the customization setting associated with the data wirelessly received from the mobile device, and upon a placement of a wager amount which causes a decrease of an amount of the credit balance, displaying, by a display device, a first play of a wagering game which utilizes the customized interface to present the custom media content, wherein the credit balance is increasable via an acceptor of a physical item associated with a monetary value, and the credit balance is decreasable via a cashout device, and responsive to no data associated with the customization setting being received from the mobile device, upon the placement of the wager amount which causes the decrease of the amount of the credit balance, displaying, by the display device, a second, different play of the wagering game which utilizes the default interface to present the default media content which is different than the custom media content.

16. The method of claim 15, further comprising, responsive to a request to pair the mobile device being received and the designated mobile device application not being installed on the mobile device, displaying, by the display device, an instruction to download the designated mobile device application to the mobile device.

17. The method of claim 16, wherein the displayed instruction includes a machine readable code.

18. The method of claim 15, further comprising associating, by at least one processor, the customization setting with a player account of a player.

19. The method of claim 15, further comprising reverting, by at least one processor, to the default setting upon a determination to cease utilizing the customization setting.

20. The method of claim 15, wherein the custom media file is stored by the mobile device prior to being wirelessly received from the mobile device in association with the designated mobile device application.

21. The method of claim 15, wherein the custom media content is selected from the group consisting of: a symbol associated with the first play of the wagering game, a sound associated with the first play of the wagering game, and a background element associated with the first play of the wagering game.

* * * * *